United States Patent [19]

Grati

[11] Patent Number: 4,550,853

[45] Date of Patent: Nov. 5, 1985

[54] BLANK ARTICLE FOR ASSEMBLING INTO A CONTAINER HAVING DOUBLE OR BOX-LIKE WALLS, AND AN OPENABLE HINGE WALL

[75] Inventor: Giorgio Grati, Milan, Italy

[73] Assignee: OGRAD s.r.l., Milan, Italy

[21] Appl. No.: 457,568

[22] Filed: Jan. 13, 1983

[30] Foreign Application Priority Data

Jan. 14, 1982 [IT] Italy ..... 20474/82[U]

[51] Int. Cl.[4] ..... B65D 5/22; B65D 5/58

[52] U.S. Cl. ..... 220/416; 229/16 R; 229/23 A; 229/33; 229/34 HW

[58] Field of Search ..... 220/416, 418; 229/23 A, 229/33, 36, 34 HW, 31 FS, 35, 16 R

[56] References Cited

U.S. PATENT DOCUMENTS

| | | | |
|---|---|---|---|
| 1,168,563 | 1/1916 | Rosenwald | 229/23 A |
| 2,811,298 | 10/1957 | Jones | 229/34 HW |
| 2,902,200 | 9/1959 | Manners | 229/36 X |
| 2,913,162 | 11/1959 | Goltz | 229/36 X |
| 2,963,211 | 12/1960 | Agler | 229/34 HW |
| 3,008,626 | 11/1961 | Lawrence | 229/35 X |
| 3,039,673 | 6/1962 | Modica | 229/36 X |
| 3,184,136 | 5/1965 | Forbes, Jr. | 229/36 X |
| 3,291,367 | 12/1966 | Carter | 229/33 |
| 3,331,548 | 7/1967 | Cassidy | 229/34 HW X |
| 3,441,193 | 4/1969 | Castle | 229/33 |
| 3,598,233 | 8/1971 | Jasinover | 229/23 A X |
| 3,854,651 | 12/1974 | Osborne | 229/36 X |
| 4,053,101 | 10/1977 | Hart, Jr. | 229/36 |
| 4,129,247 | 12/1978 | McCall | 229/36 |
| 4,257,550 | 3/1981 | Frohlicher | 229/33 X |
| 4,341,339 | 7/1982 | Zove | 229/34 HW |
| 4,347,968 | 9/1982 | Cornell et al. | 229/36 X |
| 4,353,495 | 10/1982 | Jes | 229/33 X |

FOREIGN PATENT DOCUMENTS

| | | | |
|---|---|---|---|
| 666571 | 7/1963 | Canada | 229/34 HW |
| 2804211 | 8/1979 | Fed. Rep. of Germany | 229/34 HW |
| 538976 | 8/1941 | United Kingdom | 229/34 HW |
| 1415705 | 11/1975 | United Kingdom | 229/34 HW |

*Primary Examiner*—Allan N. Shoap

*Attorney, Agent, or Firm*—Fleit, Jacobson, Cohn & Price

[57] ABSTRACT

A blank article for forming a container, including a bottom panel, side sections extended from said bottom panel and bounded therefrom by side crease-lines, a front section extended from said bottom panel and defined therefrom by a front creaseline, a rear section extended from said bottom panel and defined therefrom by a rear creaseline; said front section includes first and second front panels foldable on each other and spaced apart by spacing bands, to form a front box-like wall which is rotatable or flappable about said front creaseline acting as a hinge.

7 Claims, 4 Drawing Figures

64
75
20
59
63
58
74
77
75a
56
57
55
72
76
52
67
74a
77a
51
18
65a
53
41
72a
76a
48
47
68
67a
52a
42
45
70a
70
14
67a
68a
48a
80
29
50
66a
15'a
42a
18a
15a
15'a
45a
41a
22
12
25a
29a
40
21
23a 81
80
81a
82
82a 53
55
51
54
56
55a
59
60
58
42
72
74
57
80
66a
52a
29
17
28
72a
22
38
N
25a
21
12
40
23a

BLANK ARTICLE FOR ASSEMBLING INTO A CONTAINER HAVING DOUBLE OR BOX-LIKE WALLS, AND AN OPENABLE HINGE WALL

This application relates to sheet material precut or anyhow shaped in outline and creased or scored so as to be readily formable in a predetermined shape. Cutting and creasing of the material may be carried out in any known manner, generally by die-cutting. Such a sheet will be hereinafter referred to as a "blank" or "blank article".

With "crease" or "creaseline" it is here intended a scored or recessed line mechanically impressed on a cardboard or plastic sheet, to allow the same to be bended or folded.

It is an object of the present invention to provide a blank enabling a relatively easy realization of an openable door container, which is particularly strong and of pleasant appearance, and may be used for furnishings.

It is a further object of the invention to provide such a blank completely exploiting a sheet of basic material, thus affording a minimal waste of material.

The novel blank comprises a bottom panel, side sections extended from the bottom panel and bounded therefrom by side creaselines, a front section and a rear section extended from said bottom panel, said sections being bounded from the bottom panel by creaselines, said front section comprising first and second front panels foldable on each other and spaced apart by spacing or "thickness" bands, to form a box-like front wall rotatable or flapping about a front crease acting as a hinge, said front section when assembled being a flapping door or flap for the container.

According to further features of this invention, the front section sequentially comprises proceding outwardly from the front crease outwardly, a first front panel, a spacing band, a second front panel higher than the first panel, a second spacing band and a securing fin or tab; said front section further comprising fins or tabs which may be folded in the thickness direction of the assembled door and securing tongues on the side edges of said panels.

Each side section comprises two side panels, that is a first panel and a second panel respectively, which may be box-like folded on each other to form box-like side walls. Preferably, each side section also comprises a strip which is arranged against a rear wall of the container being formed.

According to a further feature, the rear section of the container comprises a rear panel, an upper panel which in the assembled container forms the top for the latter, and further side panels which are located against said side panels. Bands, which are foldable in rib like form, serve for upper panel stiffening in the assembled container.

A blank thus provided has a first advantage of being readily assemblable for composing a hinged door container, having box-like side walls and door, which are accordingly sufficiently strong. A second advantage of the blank thus formed resides in enabling to completely exploit a sheet of basic material, which may be a plasticized cardboard or the like, such as a multilayer of plasticized cardboard.

The invention will now be further described with reference to an embodiment shown in the accompanying drawings, in which.

Figure 1:
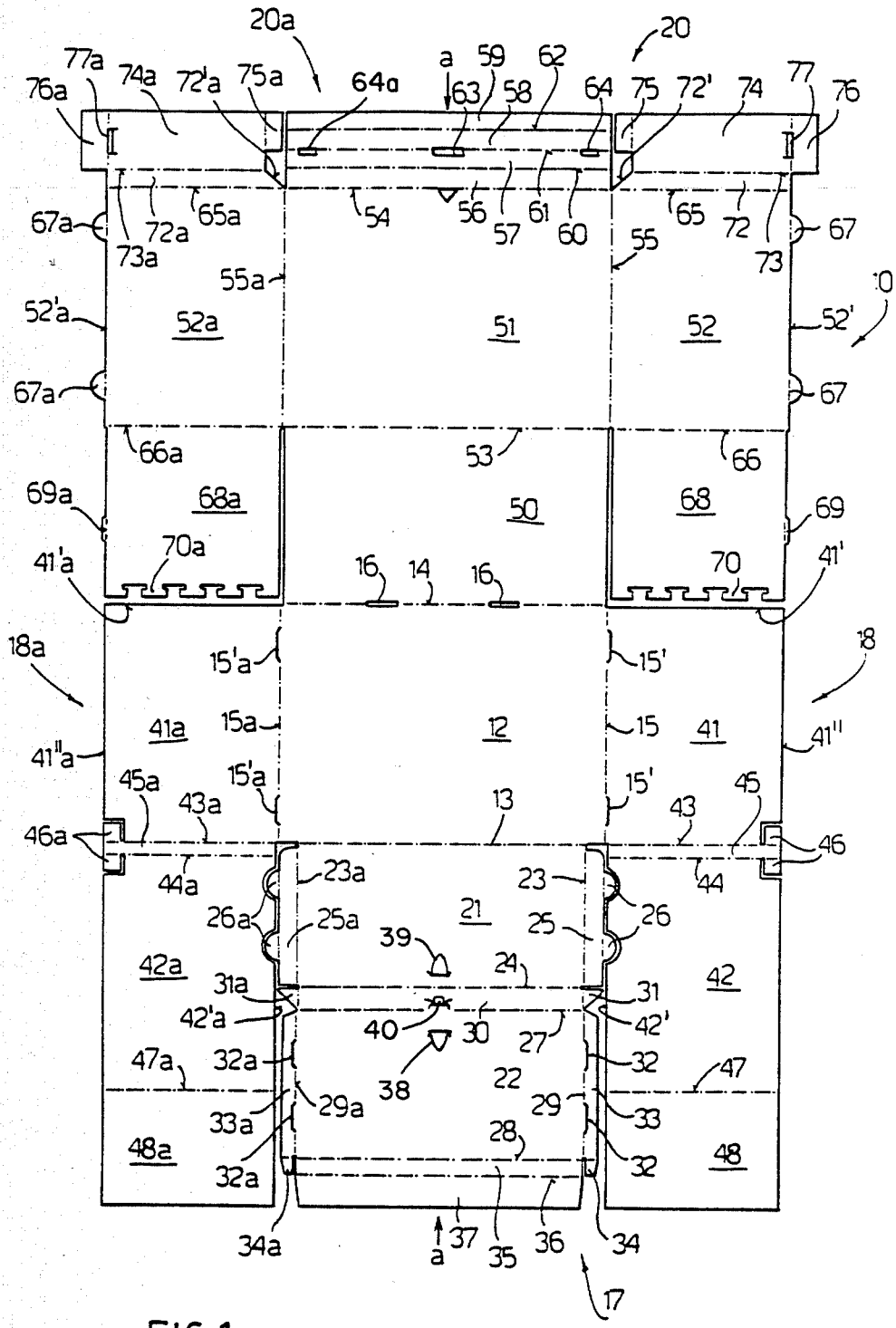
FIG. 1 is a plan view of a spread out blank, being symmetrical to the axis a which is shown chain line.

A blank 10 according to this invention is symmetrical to a longitudinal axis shown at a in FIG. 1; the blank portions on the left side of axis a bear the same references as corresponding portions on the right side of said axis, further marked with a letter a. It should be noted that on the drawings cutting lines are shown by continuous lines, while creases or creaselines are shown by thin chain line. It should be further noted that the terms "front", "rear", etc. are meant with reference to the position of a container comprising said blank and arranged as in FIG. 4, that is openable to the observer, and should not be intended as restrictive.

The novel blank 10 comprises a bottom panel 12 of quadrangular shape, bounded or defined by front, rear and side crease lines 13, 14, 15, 15*a*, respectively. The crease line 14 has two notches, denoted at 16, 16*a*. The crease line 13 defines panel 12 from the elements which will be defined as "front section" 17 and will form an openable hinge door. The crease 15 (and 15*a* respectively) defines the bottom panel 12 from elements which will be referred to as "side sections" 18 or 18*a*, respectively. The crease or creaseline 14 defines the bottom panel 12 from elements which will be referred to as "rear-upper section" 20.

The front section 17 comprises a first front panel 21 and a second front panel 22, substantially of a same width, while the height of the second panel 22 is preferably slightly larger than that of the first panel 21. In addition to being bounded by crease 13, said panel 21 is defined by further side creases 23 and 23*a*, and 24 parallel to crease 13. In addition to said creases 23 and 23*a*, there are also spacing or "thickness" bands 25 and 25*a* having clamping tongues 26 (26*a*) at the outer edge. With spacing or thickness bands those parts of the blank are meant which space apart two panels and determine the thickness of a box-like wall. The second front panel 22 is defined by creases 27, 28, 29 and 29*a*. A strip or band 30 is located between creases 24 and 27 and is preferably extended at the extreme edges by fins or tabs 31, 31*a*. The crease 29 is interrupted by notches 32 and a spacing band 33 extends beyond thereto, preferably extended by fins or tabs 34. Beyond said crease 28 extends a spacing band 35 separated by a crease 36 from a fin or tab 37. Preferably, said panels 21 and 22 have parallel notches 38 and 39, and a notch 40 adjacent to crease 27, parallel thereto and to the crease, forms a slightly projecting tooth for a purpose to be further explained in the following.

Each side section 18, 18*a* comprises a first side panel 41 or 41*a*, respectively, and a second side panel 42 or 42*a* which, in the spread out blank, extend forwardly of each first side panel and on the sides of the front section, but separated therefrom. In addition to being bounded by creaseline 15, said first side panel 41 is bounded by cutting lines 41' and 41'' and a crease 43. The latter and a further creaseline 44 parallel thereto define a spacing band 45, having two fins or tabs 46 connected thereto at one end, said fins or tabs being formed in the bodies of said panels 41 and 42. This panel 42 is bounded by two creases 44 and 47 and cutting lines, of which cutting line 42', as shown, has hollowed cut portions for the formation of the above mentioned tongues 26. A strip 48 or rear semi-panel extends beyond said creaseline 47 and performs a function to be explained in the following.

The rear-upper section 20 comprises a rear panel 50, an upper panel 51 and third side panels 52 and 52*a*. In addition to being bounded by said crease 14, the rear panel 50 is bounded by cutting lines on the sides and a further creaseline 53. The size of the upper panel 51 is substantially similar to those of said bottom panel 12, this upper panel 51, in addition to said creaseline 53, being bounded by the further creaselines 54, 55 and 55*a*. A rib portion extends beyond said creaseline 54 and comprises a series of bands marked by reference numerals 56, 57, 58 and 59, bounded by creaselines 60, 61 and 62. An opening 63 is provided along creaseline 61 and is at least as long as tooth 40, above referred to in connection with the front section. Any further notches define stop teeth 64. In addition to said creaseline 55, the third side panel 52, (52*a*) is defined by further creaselines 65 and 66, (65*a*, 66*a*) and a cutting line 52', (52'*a*) defining clamping tongues 67, (67*a*). A rear limb or semipanel 68, (68*a*) extends beyond said creaseline 66, (66*a*) and terminates with undercut engagement tongues 70, (70*a*). On an outer edge of strip 68, (68*a*) there is provided a tooth 69, (69*a*). The strip 68*a*, has tongues 70*a* at offset position relative to tongues 70, to allow a mutual engagement therebetween. For an optimus use of material, the container height, that is the dimension between creaselines 14 and 53, should be related to the width thereof (dimension between creaselines 15 and 15*a*), so that strips 68 and 68*a*, provided along the height dimension of the container, are enabled to be arranged against each other with the tongues engaged therebetween, when the container is assembled to stiffen the rear panel 50.

A band 72, (72*a*) extends beyond creaseline 65, (65*a*) and is defined by a further creaseline 73, (73*a*) and cutting lines, of which one cutting line 72', (72'*a*) is inclined. A strip 74, (74*a*) extends beyond creaseline 73, (73*a*), which strip is joined at the opposite sides along creaselines, to fins or tabs 75 and 76, (75*a*, 76*a*) an opening 77 being provided between the latter and said strip 74, (74*a*).

Figures 2, 3, 4:
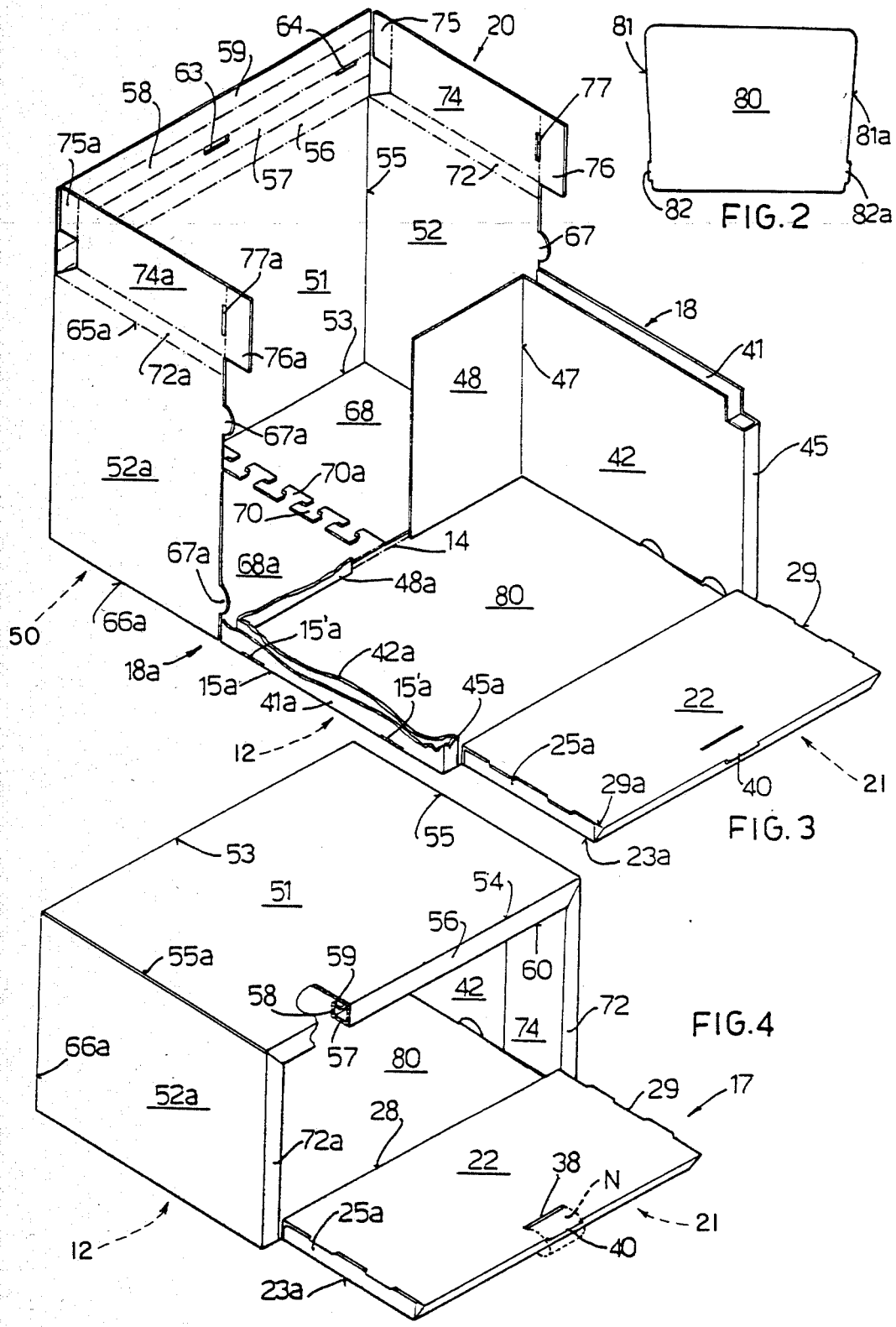
FIG. 2 is a plan view of a stiffening element for the blank shown in FIG. 1.
FIG. 3 is an enlarged perspective view of the blank shown in FIGS. 1 and 2, partly assembled in an enlarged scale with respect to said figures and partially broken away to show portions at the back.
FIG. 4 is a perspective view of the blank, completely assembled partially broken away to show the composition thereof.

A stiffening sheet 80 (FIG. 2) may be provided and cut at a total size corresponding to that of the bottom panel 12. Stiffening sheet 80 is shown in FIGS. 3 and 4 located above bottom panel 12, which is shown by phantom line 12 in FIGS. 3 and 4. Preferably, said stiffening sheet has tapered side walls 81 and 81*a* provided with teeth 82 and 82*a*.

The assembling of the container from said blank 10 will now be described.

The side sections 18 and 18*a* are folded, each as clearly shown in FIG. 3. That is to say, each panel 41, (41*a*) is folded orthogonally to the bottom panel 12, and each panel 42, (42*a*) along panel 41 respectively (41*a*) internally thereto and spaced apart therefrom by the thickness of band 45 respectively (45*a*). The strip 48, (48*a*) folded to arrange along creaseline 14.

The ends of bands 45 and 45*a* and fins or tabs 46, (46*a*) are folded to form a step. In the rear section, panel 51 is folded at right angles to panel 50 along creaseline 53; panels 52 and 52*a* are folded at right angles to panel 51 along creaselines 55 and 55*a*, and strips 68 and 68*a* are folded along creaselines 66 and 66*a*, respectively, at right angles to panels 52, (52*a*), thus overlying said panel 50 as shown by phantom line 50 in FIG. 3. Then, the clamping fins or tabs 70 and 70*a* are secured to one another.

The whole rear section is then rotated about creaseline 14 to bring panel 52*a* and 52, respectively, externally against panel 41*a* and 41, respectively. Bands 56, 57, 58 and 59 are folded in a box-like fashion to form a stiffening rib at the end of the upper panel 51, which rib will be seated in the step provided at the end of said bands 45 and 45*a*.

Then, bands 72 and 72*a*, respectively, are folded against bands 45 and 45*a* and fins or tabs 74 and 74*a* internally of the parallelepiped container thus obtained along the side panels 42 and 42*a*. The fins or tabs 76 and 76*a* are folded along the bottom panel 12. The mutual position for the parts hitherto mentioned is set by engagement of fins or tabs 67 and 67*a* in notches 15' and 15'*a*.

The front section is folded along creaselines 24, 27, 28 and 36 to arrange said panel 22 along panel 21 as shown by phantom line 21 in FIGS. 3 and 4, separated therefrom by a same thickness as that of band 35. Fin or tab 37 is arranged along panel 21. Fins or tabs 25, 31, 33 and 34 are folded along the sides, i.e. along the thickness of the wall thus formed, and securing is provided by engagement of tongues 26 and 26*a* in notches 32 and 32*a*. The front wall 17, when assembled remains rotatable or flapping about the hinge comprised of said creaseline 13. Tooth 40 is an engagement point or tip for holding the hinge wall 17 closed and can engage in opening 63. The notches 38 and 39 are for a ribbon N (drawn by hatching in FIG. 4), which may be applied for gripping engagement and improving the engagement of tooth 40 in opening 63. The container bottom is reinforced by application of stiffening panel 80, the limbs 82 and 82*a* of which preferably engage in notches of said panels 42 and 42*a*.

What I claim is:

1. A blank article for forming a container, said blank article comprising a bottom panel, two side sections extending from said bottom panel, two side creaselines each being defined between said bottom panel and one of said two side sections, a front section extending from said bottom panel, a front creaseline defined between said front section and said bottom panel, a rear upper section extending from said bottom panel, a rear creaseline defined between said rear upper section and said bottom panel, each of said two side sections comprising a first side panel, a second side panel foldable in a box-like fashion on said first side panel, and a first spacing band located therebetween, said rear upper section comprising a rear panel bounded from the bottom panel by said rear creaseline, and an upper panel extending from said rear panel, an upper creaseline defined between said upper panel and said rear panel and extending parallel to the rear creaseline, said rear upper section further comprising two third side panels extending from the sides of the upper panel, two rear side creaselines defined between each third side panel and said upper panel, a plurality of second bands extending from the end of the upper panel located opposite to the upper creaseline, band creaselines bounding each of said plurality of second bands, said plurality of second bands being foldable in rib-like fashion along said band creaselines, said front section comprising successively from said front creaseline a first front panel, a third spacing band, a second front panel, said second front panel being foldable on said first front panel and being spaced apart by said third spacing band, a front box-like, door-like wall being formed by said first front panel, said third spacing band and said second front panel when the container is assembled, said bottom panel being separated from said wall by said front creaseline and said wall being hingedly pivotable about said front creaseline.

2. A blank article according to claim 1, wherein said second front panel is of a larger height than said first front panel and said front section further comprises successively from said second front panel outwardly, a fourth spacing band and a securing tab; said front section also comprises spacing tabs and securing tongues located on side edges of said first front panel and said second front panel.

3. A blank article according to claim 1, wherein said rear upper section further comprises two semi-panels for bottom stiffening extending from said two third side panels, semi-panel creaselines each defined between one of said two third side panels and one of said two semi-panels and interengaging tongues being located at one end of each of said two semi-panels opposite to said semi-panel creaseline, said interengaging tongues located at the ends of each semi-panel being offset for interengagement.

4. A blank article according to claim 3, further comprising a fifth spacing band and a strip foldable internally of the container extending from the side of each said third side panel opposite to said semi-panels.

5. A blank article according to claim 1, wherein the outer profile of the blank is substantially reetangular.

6. A blank article according to claim 1, wherein said plurality of second bands define an elongated opening, said front wall including a projecting tooth for releasable engagement in said elongated opening.

7. A blank article according to claim 1, further comprising a stiffening element having a complementary shape to said bottom panel for insertion in said container above said bottom panel.

* * * * *